United States Patent [19]

Beke et al.

[11] 4,186,496

[45] Feb. 5, 1980

[54] WEB DRIER SECTION

[75] Inventors: Zoltan Beke, Lasalle; George W. Kukla, Dollard des Ormoux, both of Canada

[73] Assignee: Dominion Engineering Works Limited, Lachine, Canada

[21] Appl. No.: 949,222

[22] Filed: Oct. 6, 1978

Related U.S. Application Data

[63] Continuation of Ser. No. 777,770, Mar. 15, 1977, abandoned.

[51] Int. Cl.[2] ..... F26B 13/08

[52] U.S. Cl. ..... 34/114; 34/120; 34/156

[58] Field of Search ..... 34/18, 23, 68, 114, 34/119, 120, 124, 159, 156; 162/290, 359

[56] References Cited

U.S. PATENT DOCUMENTS

| | | | |
|---|---|---|---|
| 2,081,945 | 6/1937 | Massey et al. | 34/156 |
| 3,052,991 | 9/1962 | Goldner | 34/89 |
| 3,199,219 | 8/1965 | Braver et al. | 34/156 |
| 3,216,638 | 11/1965 | Brickle et al. | 34/156 |
| 3,570,136 | 3/1971 | Hakanson | 34/114 |

FOREIGN PATENT DOCUMENTS

| | | | |
|---|---|---|---|
| 1111137 | 9/1958 | Fed. Rep. of Germany | 34/156 |

*Primary Examiner*—Larry I. Schwartz
*Attorney, Agent, or Firm*—Raymond A. Eckersley

[57] ABSTRACT

The operation of paper machines making light weight webs at higher speeds wherein satisfactory drying of the webs is frequently precluded by the occurrence of web flutter within the drier section, is made possible by the provision of floater headers integrated with the hood structure of the Papridrier (T.M.), to provide support to the web substantially throughout its length until a sufficient degree of dryness is reached whereat the web is sufficiently strong to withstand flutter generated forces.

6 Claims, 2 Drawing Figures

WEB DRIER SECTION

Figure 1:
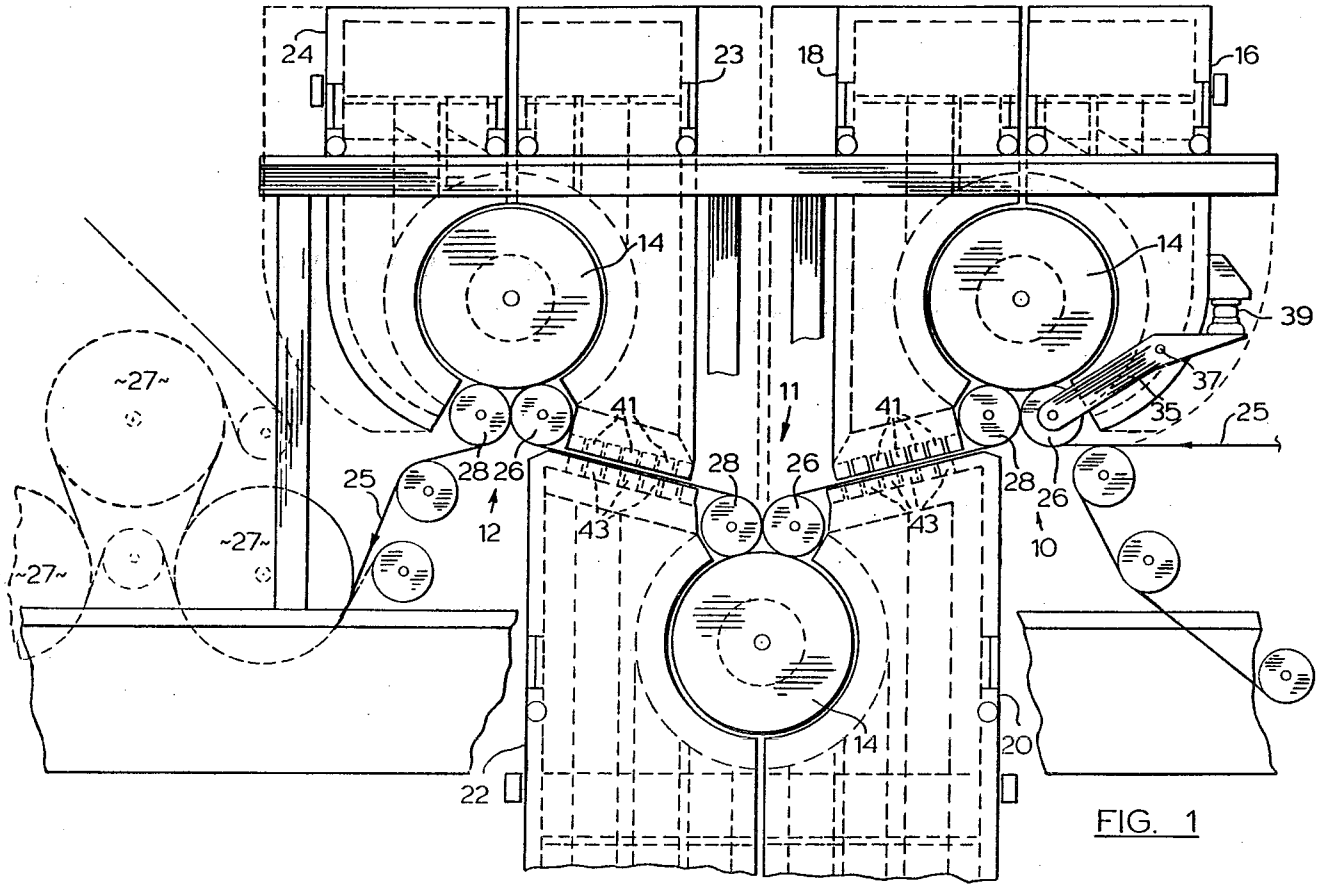

This is a continuation application for application Ser. No. 777,770, filed Mar. 15, 1977 now abandoned.

This invention is directed to a web drier section and in particular to a drier section having integrated therewith provision for precluding flutter over a critical portion of the web path.

In the operation of modern paper machines progress towards greater productivity, which can be obtained by using high speed forming sections capable of operating at speeds in excess of 3000 feet per minute, has been impeded by the inability of the associated drier section to safely dry the web at such speeds.

The ineffectiveness of existing drier sections arises not because of an absence of the necessary drying capacity, but because of the occurrence of web flutter which takes place at the associated high speeds, causing frequent breakage of the web due to flutter, on passage through the drier section.

The presently disclosed apparatus makes provision for the passing of a fragile wet paper web at a speed sufficiently high to normally produce destructive flutter, in substantially continuously supported relation to a first porous drying surface, impinging hot air in drying relation towards the porous surface against one face of the web, to dry the web and applying vacuum on the other web face to secure it to the surface and percolate air through the web, passing the web from the first drying surface to a second drying surface, and supporting the web intermediately between the first and second surfaces between substantially balanced impinging air jets, to preclude web flutter and promote drying of the web.

The apparatus provided comprises two or more identical high velocity drier drum sets having drums rotatably mounted in mutually spaced relation, an off-going turning roll of at least one set and on-going turning rolls of the remaining sets providing therebetween an intermediate web draw section or sections connecting adjoining drier sets, and air blown floater header means located in predetermined spaced relation on opposite sides of the web path to provide in operation substantially balanced web-stabilizing pneumatic forces to the opposed faces of the web, to ensure passage thereof in stable non-fluttering relation between adjacent drum sets.

The drier sets are each provided with a hood encompassing a major portion of the periphery of the respective drum, each hood incorporating therewith a respective portion of the floater header, to provide access to the web path through the drier machine whereby removal of the web and rethreading of the web is rapidly facilitated, with a minimum of inconvenience upon displacement of the floater headers with the hoods.

Thus, the presently disclosed apparatus provides a drier section capable of operation in a range of speeds not previously practicable, and arranged to permit clearance of broke and rethreading of the section with minimum interruption of production.

The presently disclosed apparatus permits the provision in one embodiment of opposed floater header means each comprising a plurality of mutually spaced blower boxes arranged in sequence along the web path, having an exhaust passage between at least two adjacent ones of the boxes for recirculation of air therethrough for return passage within the associated hood, the blower boxes of one header being arranged in non-aligned relation with the corresponding boxes of the facing other header.

Provision is made for the web turning rolls to be suction rolls having both a suction box and a blower box therein, whereby transfer of the web onto the roll surface at a first angular position and from all the roll surface at a second angular position is facilitated.

Figure 2:
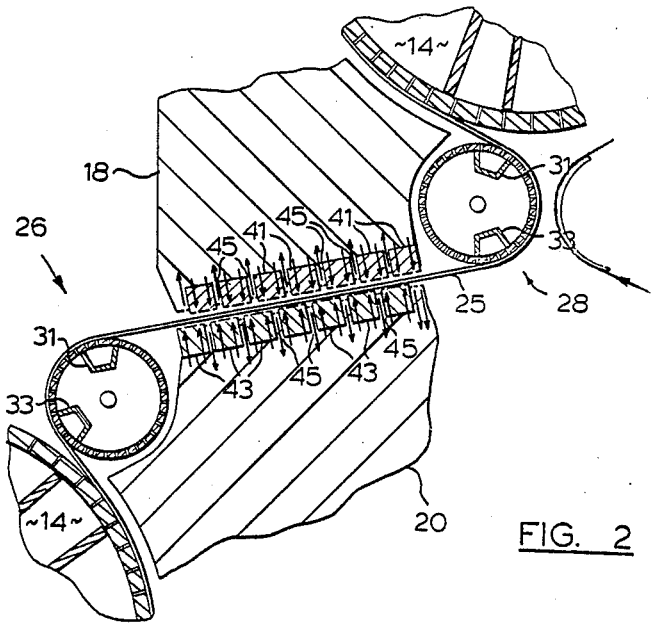

Certain embodiments of the invention are described, reference being made to the accompanying drawings, wherein;

FIG. 1 is a schematic side view of a portion of a drier according to the present invention having the end covers removed, and FIG. 2 is an enlarged view of a portion of FIG. 1, with the end covers of hoods, blower boxes, drier rolls and turning rolls removed.

Referring to the drawings, in FIG. 1 is shown a set of three high velocity driers 10, 11, 12, each having a drier drum 14 rotatably mounted within two halves 16, 18; 20, 22; and 23, 24 respectively of the split hoods. The arrangement is shown in serial relation with a portion of a conventional drier section having drier rolls 27.

The drums 14 are permeable on their peripheral surfaces, each being provided with a suction arrangement (not shown) that is well known in the art, to provide a required degree of suction at the arcuate drum surface on which the paper web 25 is supported. Each drum 14 has an on-going roll 26 and off-going roll 28, illustrated in FIG. 2 as being perforate rolls containing suction boxes 31, and pressurized boxes 33, to facilitate web handling, particularly during start-up.

In FIG. 1 is shown a control arm 35 pivotally mounted at 37, controlled by way of an air bag 39 which can be used to vary the web path and provide clearance between the respective turning roll 26, or 28 and the respective drier drum 14. While only one such arm is shown it will be understood that each turning roll 26, 28 is so provided.

The run of the web 25 extends between the opposed hood portions 18, 20, and 22, 23 and at these portions of the web path a plurality of floater headers 41, 43 in opposed but mutually staggered relation provide air jets and return flow paths 45 therebetween into the respective hood 18, 20; 22, 23.

The floater headers 41, 43 are relatively adjustable in relation to the respective hoods 18, 20 so that with the hoods in their normal operating position the headers 41, 43 are adjusted by way of air flow and spacing to provide the desired flutter-free stability of web passage therebetween. Upon the occurrence of a web breakage or for any other purpose, the hood halves 18, 20 can be rapidly withdrawn, thereby retracting the headers 41, 43 therewith.

Upon repositioning the hood halves 18, 20 back into their respective operating registries, the headers 41, 43 also are positioned in correct registry, so that ideal conditions for satisfactory web passage are restored with minimal interruption. Integration of air supply (not shown) to the headers 41, 43 with that of the hoods, and the existance of integrated return flow paths 45 ensures the provision of web stabilizing air automatically with the operation of the hood, also integrating with the hood the drying effect of the air jets from the headers 41, 43.

Thus it will be seen that there is provided retractable hood means defining a web path way therebetween, and air headers having return flow passages therebetween, being integrated in terms of structure and function with the hood means and respective turning rolls associated therewith, to provide an integrated guide path to facilitate rapid clearance and rethreading of a paper web, for high speed flutter-free passage in effective drying relation therethrough.

The subject arrangement is shown in FIG. 1 in relation to a standard drum drier section, and may thus be used in such combination, to permit the uprating of a paper making facility, while providing continuous web support in the most vulnerable transfer zones.

Upon consideration that the respective value of hourly output of such an ultra high speed paper-machine and drier, typically in the order of $4500 per hour, the contribution thereto afforded by an improved drier system capable of matching the output speed of the machine, in which the drier function is enhanced with regard to speed and drying rate, and machine down-time due to web breakage is minimized, it will be appreciated that the present invention provides a most useful and unobvious benefit.

What we claim as new and desire to secure by Letters Patent of the United States is:

1. A drier for a fragile, light weight paper web, having at least two drier drums in spaced apart relation, hood means positioned about portions of the periphery of the respective drums and extending oppositely in spaced apart relation from each other to provide a web draw passage located between the opposed hood means, having an off-going web guide and an on-going web guide located at the ends of the passage a plurality of floater header means located on opposite sides of the web passage in aligned mutually opposing relation extending substantially the full length of the passage, having air jet means directed substantially normally to the opposed surfaces of the web, and return flow air passage means spaced along the passage to receive exhaust air therefrom to provide in operation a balanced air cushion open draw applying substantially balanced web-stabilizing pneumatic forces to the opposite surfaces of the web to permit high speed passage thereof in non-fluttering relation along the draw passage.

2. The drier as claimed in claim 1 wherein said floater header means are located within a respective said hood means, in air flow coordinated and positioned relation therewith.

3. The drier as claimed in claim 2 wherein each said floater header means comprises a plurality of mutually spaced blower boxes having exhaust passages extending between adjacent pairs of said boxes to permit recirculation of air from said boxes to said hood means, the boxes of one said hood means being in non-aligned facing relation with the boxes of the facing hood means.

4. The drier as claimed in claim 2, including hood mounting means to permit uninterrupted withdrawal of individual ones of said hood means in increased spaced relation from the path of said web, to provide access thereto, and to permit controlled closure of said individual hood means in predetermined relation to other ones of said hood means.

5. A drier for a fragile, light weight paper web, having at least two drier drums in spaced apart relation, hood means positioned about portions of the periphery of the respective drums and extending oppositely in spaced apart relation from each other to provide a web draw passage located between the opposed hood means, having an off-going web guide and an on-going web guide located at the ends of the passage a plurality of floater header means located on opposite sides of the web passage in aligned mutually opposing relation extending substantially the full length of the passage, each header means comprising a plurality of mutually spaced blower boxes having exhaust passages extending between adjacent pairs of said boxes to permit recirculation of air from the boxes to the hood means, with outlet jets from the blower boxes of one said hood means being in non-aligned facing relation with outlet jets of the boxes of the facing hood means, the outlet jets being directed substantially normally to the web surfaces to provide in operation a balanced air cushion open draw applying substantially balanced web-stabilizing pneumatic forces to the opposite surfaces of the web to permit high speed passage thereof in non-fluttering relation along the draw passage.

6. A drier for a fragile, light weight paper web, having at least two drier drums in spaced apart relation, hood means positioned about portions of the periphery of the respective drums and extending oppositely in spaced apart relation from each other to provide a web draw passage located between the opposed hood means, having an off-going web guide and an on-going web guide located at the ends of the passage a plurality of floater header means located on opposite sides of the web passage in aligned mutually opposing relation extending substantially the full length of the passage, having air jet means impinging substantially normally on the opposed surfaces of the web to provide in operation a balanced air cushion open draw applying substantially balanced web-stabilizing pneumatic forces to the opposite surfaces of the web to permit high speed passage thereof in non-fluttering relation along the draw passage, and hood mounting means to permit uninterrupted withdrawal of individual ones of said hood means in increased spaced relation from the path of said web, to provide access thereto, and to permit controlled closure of said individual hood means in predetermined relation to other ones of said hood means.

* * * * *

UNITED STATES PATENT AND TRADEMARK OFFICE

CERTIFICATE OF CORRECTION

PATENT NO. : 4,186,496

DATED : February 5, 1980

INVENTOR(S) : George W. Kukla & Zoltan Beke

It is certified that error appears in the above—identified patent and that said Letters Patent is hereby corrected as shown below:

First Printed Page: "Assignee: Dominion Engineering Works Limited, Lachine, Quebec, Canada"

Should Read: "Assignees: Midland-Ross of Canada Limited
Lasalle, P.Q., Canada and Dominion Engineering Works Limited
Lachine, P.Q., Canada Signed and Sealed this

*Fifteenth* Day of *July 1980*

[SEAL]

*Attest:*

SIDNEY A. DIAMOND

*Attesting Officer*

*Commissioner of Patents and Trademarks*